United States Patent [19]

Hansson

[11] 4,372,534

[45] Feb. 8, 1983

[54] PNEUMATIC HOIST

[75] Inventor: Gunnar C. Hansson, Stockholm, Sweden

[73] Assignee: Atlas Copco Aktiebolag, Nacka, Sweden

[21] Appl. No.: 247,068

[22] Filed: Mar. 24, 1981

[30] Foreign Application Priority Data

Mar. 28, 1980 [SE] Sweden ..... 8002408

[51] Int. Cl.[3] ..... B66D 1/08; B66D 1/48; B66D 3/24

[52] U.S. Cl. ..... 254/269; 254/360

[58] Field of Search ..... 254/269, 270, 290, 291, 254/314, 360, 361

[56] References Cited

U.S. PATENT DOCUMENTS

| | | | |
|---|---|---|---|
| 1,561,722 | 11/1925 | Jimerson | 188/170 |
| 2,178,305 | 10/1939 | Smaltz et al. | 254/361 X |
| 2,846,984 | 8/1958 | Zwayer | 254/360 X |
| 3,368,796 | 2/1968 | Lilbing | 254/360 X |
| 3,457,837 | 7/1969 | Powell | 254/360 X |
| 3,669,411 | 6/1972 | McKendrick | 254/386 |
| 3,957,248 | 5/1976 | Hansson | 254/360 |

FOREIGN PATENT DOCUMENTS

| | | |
|---|---|---|
| 742104 | 11/1943 | Fed. Rep. of Germany . |
| 759988 | 6/1954 | Fed. Rep. of Germany . |
| 1010716 | 11/1957 | Fed. Rep. of Germany . |
| 1161402 | 1/1964 | Fed. Rep. of Germany . |
| 1403124 | 8/1975 | United Kingdom . |

*Primary Examiner*—Philip R. Coe
*Assistant Examiner*—Frankie L. Stinson
*Attorney, Agent, or Firm*—Frishauf, Holtz, Goodman and Woodward

[57] ABSTRACT

A pneumatically operated hoist includes a housing 10 provided with a suspension means 12,13 for suspension of the hoist from an overhead support, a pneumatically driven motor 15 provided with a first flow passage 75 arranged for serving as a pressurized air inlet during raising of a load and as an air exhaust passage during lowering of the load and a second flow passage 76 arranged for serving as an air exhaust passage during raising of the load and a pressurized air inlet during lowering of the load, a load engaging means 16,17 drivingly connected to the motor 15, and a control means 18 or regulating air flow to and from the motor 15. Known such hoists of this type are slow in lowering light loads or too fast in lowering heavy loads safely.

According to this invention the control means incorporates a flow restricting means 77,78 provided in said first flow passage 75 and arranged for restricting flow through said first flow passage 75 during lowering of the load, and a load sensitive shunt valve 41 arranged for providing a second air exhaust passage 69,70 during lowering of a load having a weight below a predetermined magnitude and for closing said second air exhaust passage 69,70 during lowering of a load having a weight greater than said predetermined magnitude whereby more efficient operation is obtained.

11 Claims, 6 Drawing Figures

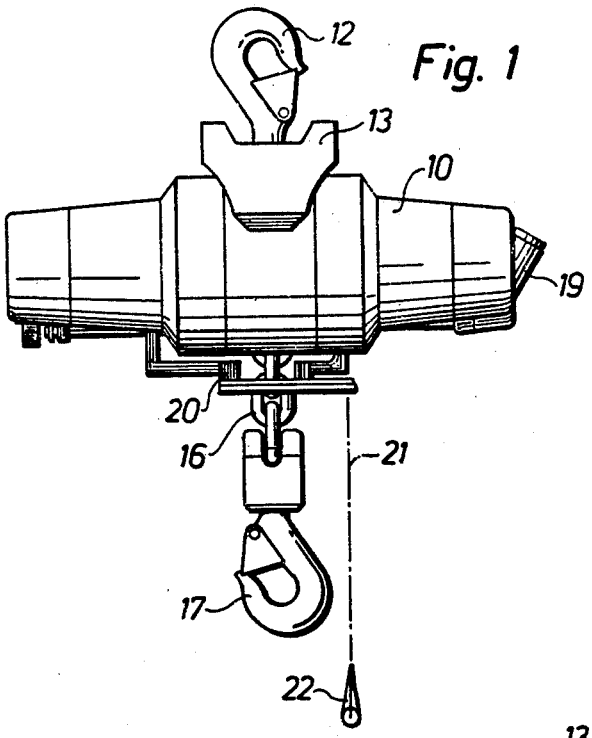
Fig. 1
Fig. 6
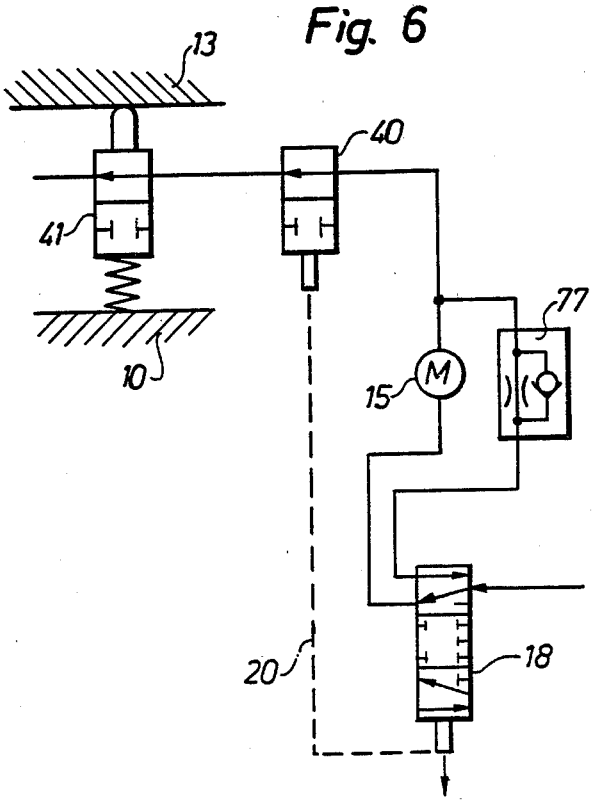

PNEUMATIC HOIST

BACKGROUND OF THE INVENTION

This invention relates to a pneumatically operated hoist comprising a housing provided with a suspension means for suspension of the hoist, in use thereof, from an overhead support, a pneumatically driven motor provided with a first flow passage arranged for serving as a pressurized air inlet during raising of a load and as an air exhaust passage during lowering of the load and a second flow passage arranged for serving as an air exhaust passage during raising of the load and a pressurized air inlet during lowering of the load, a load engaging means drivingly connected to the motor, and a control means for regulating air flow to and from the motor.

In known hoists of the above type it is not possible to provide both fast lowering for speed of operation which is permissible for light loads and slow and safe lowering required for heavy loads, as well as unrestricted load raising power under all load conditions.

It is an object of the present invention to provide a pneumatically operated hoist which overcomes or minimizes such disadvantages.

SUMMARY OF THE INVENTION

According to the present invention this is accomplished by incorporating in the control means a flow restricting means which is arranged to provide a restriction of the outlet flow from the motor during lowering of the load and a load sensitive shunt valve arranged to provide during lowering of the load a secondary air flow by-passing the flow restricting means when the weight of the load is below a predetermined magnitude.

Thus the present invention provides a pneumatically operated hoist comprising a housing provided with a suspension means for suspension of the hoist, in use thereof from an overhead support, a pneumatically driven motor provided with a first flow passage arranged for serving as a pressurized air inlet during raising of a load and as an air exhaust passage during lowering of the load and a second flow passage arranged for serving as an air exhaust passage during raising of the load and a pressurized air inlet during lowering of the load, a load engaging means drivingly connected to the motor, and a control means for regulating air flow to and from the motor, characterized in that said control means incorporates a flow restricting means provided in said first flow passage and arranged for restricting flow through said first flow passage during lowering of the load, and a load sensitive shunt valve arranged for providing a second air exhaust passage during lowering of a load having a weight below a predetermined magnitude and for closing said second air exhaust passage during lowering of a load having a weight greater than said predetermined magnitude.

With a hoist of the present invention it is possible to provide quick and safe operation by providing fast lowering of light loads and slow lowering of heavy loads without affecting full load raising power, thereby providing improved efficiency and economy of operation.

BRIEF DESCRIPTION OF THE DRAWINGS

Further preferred features and advantages of the invention will appear from the following description given by way of example of a preferred embodiment illustrated with reference to the accompanying drawings in which:

FIG. 1 is a side elevation of a pneumatically operated hoist of the invention;

FIG. 6 is a circuit diagram of the control means of the above hoist in its high speed load lowering position.

DETAILED DESCRIPTION

Figure 2:
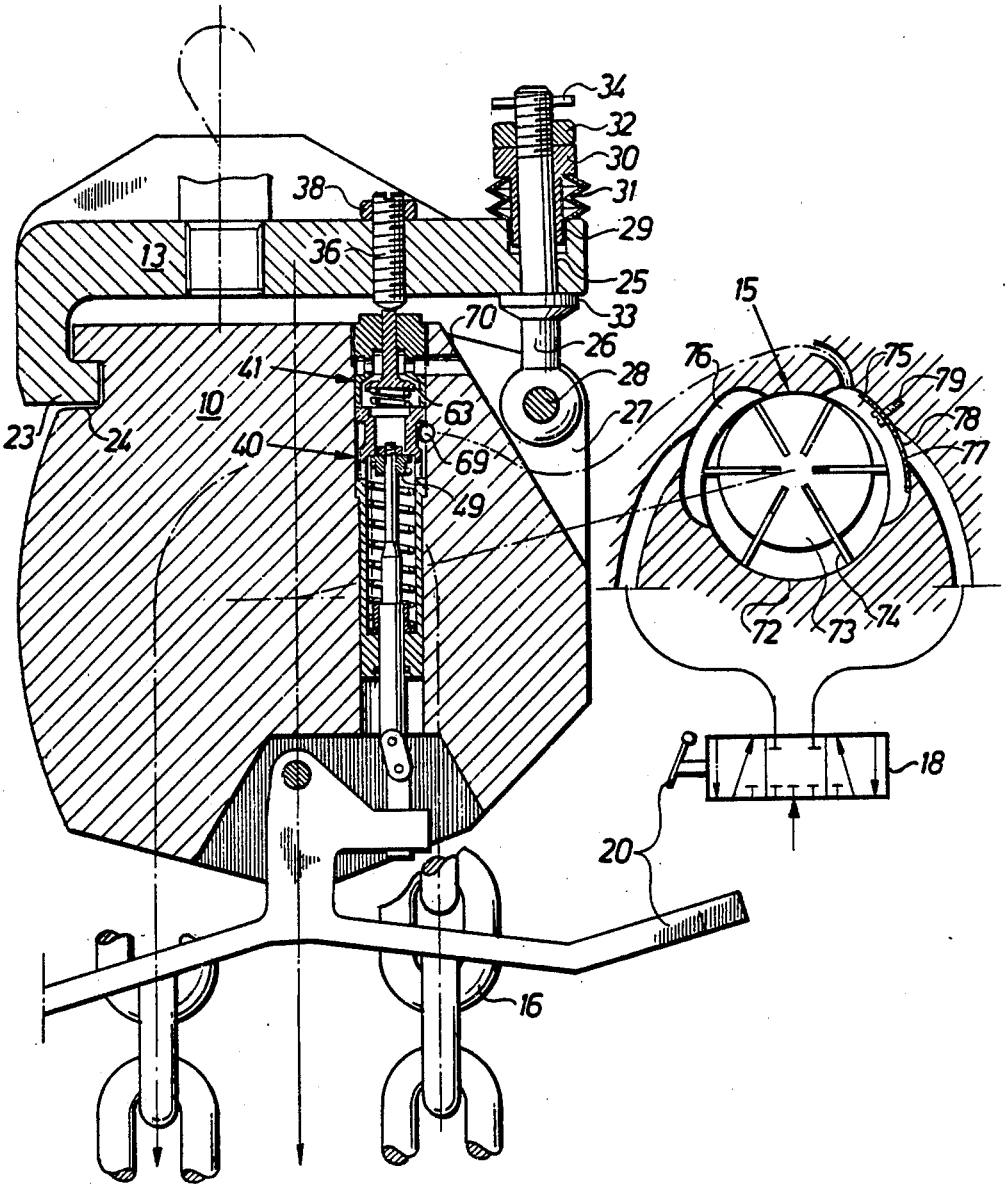
FIG. 2 is a schematically vertical cross section of the hoist of FIG. 1, the air motor and selector valve being shown in inset views for the purpose of clarity and the control means being shown in its neutral position.

The hoist comprises a housing 10 which is suspended, in use, from an overhead support such as a trolley mounted on rails or some other fixed or movable structure, by a hook 12 connected to the housing via a yoke 13. The housing 10 contains a conventional drive means including a pneumatic vane motor 15, drive transmission means including gear means, and a chain pulley (not shown) for engaging a load carrying chain 16 and brake means (not shown). At its lower end, the chain 16 is provided with a load engaging hook 17.

The housing 10 also contains control means for governing the operation of the hoist. The control means includes a selector valve 18 supplied with pressurized air via an inlet nipple 19. The selector valve 18 which is schematically illustrated in FIGS. 2 to 5 is manually operated by means of a rocking frame 20 pivotally mounted on the housing 10 and having two ropes 21 secured at their upper ends to the frame 20 and provided with handle means 22 at their lower ends.

The rocking frame 20 is designed to encircle the load carrying part of the chain 16 so as to be automatically displaced to its neutral position by the load engaging hook 17 as the latter approaches its uppermost position. This feature is a safety arrangement of conventional type and does not form an essential part of the present invention.

Figure 3:
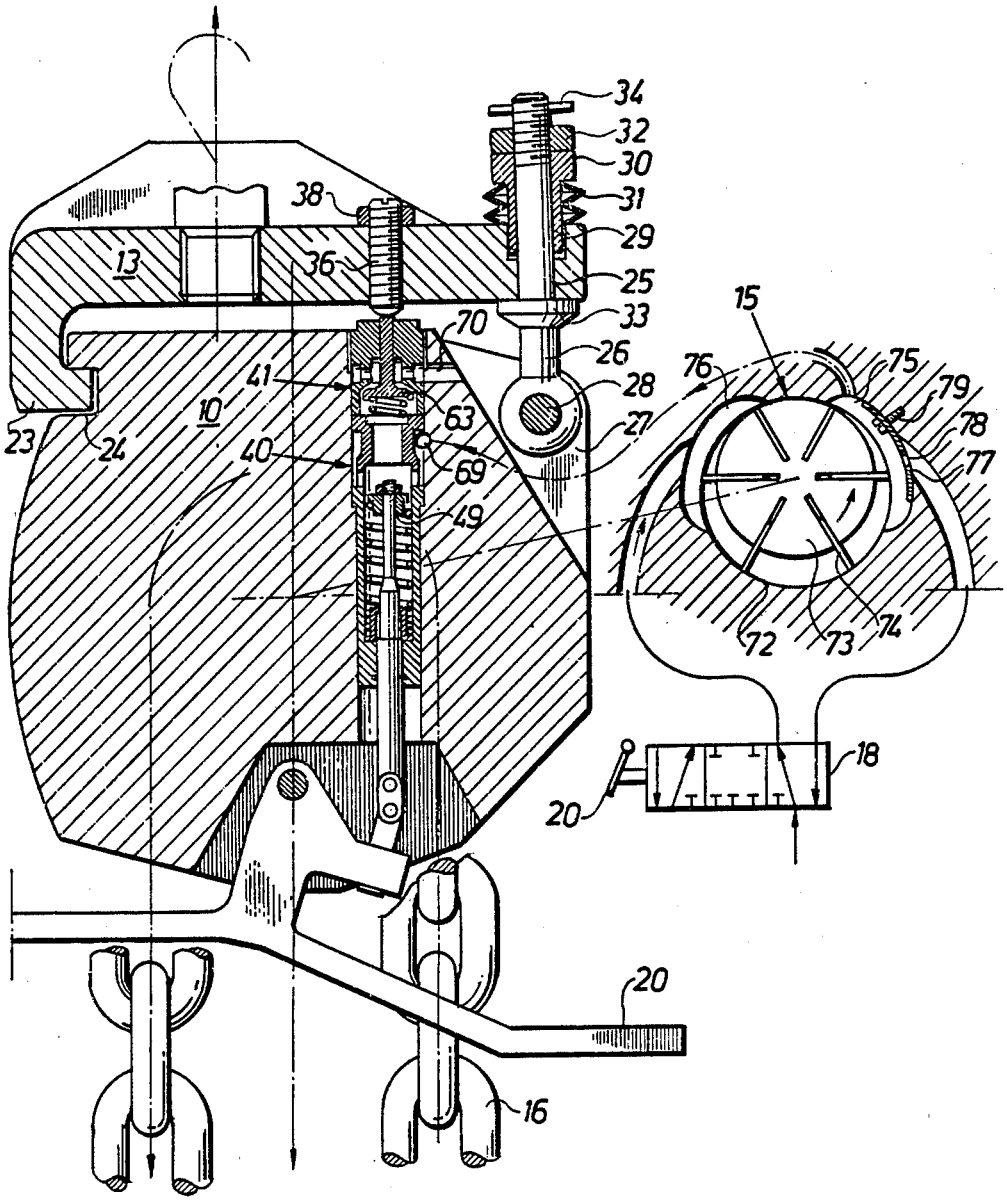
FIG. 3 is a corresponding view to that of FIG. 2 but with the control means shown in its high speed load lowering position.
Figure 4:
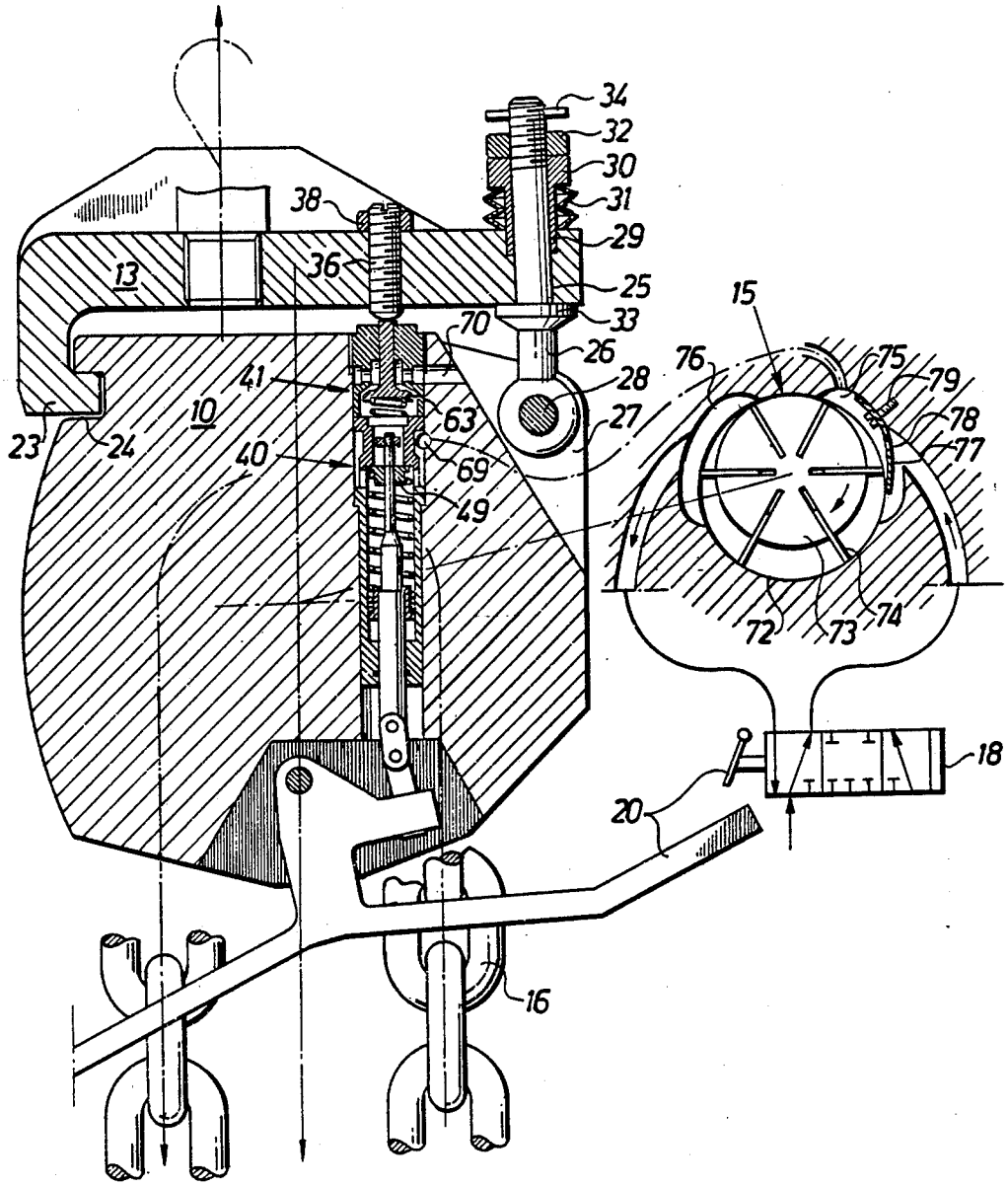
FIG. 4 is another corresponding view but with the control means shown in its load raising position.
Figure 5:
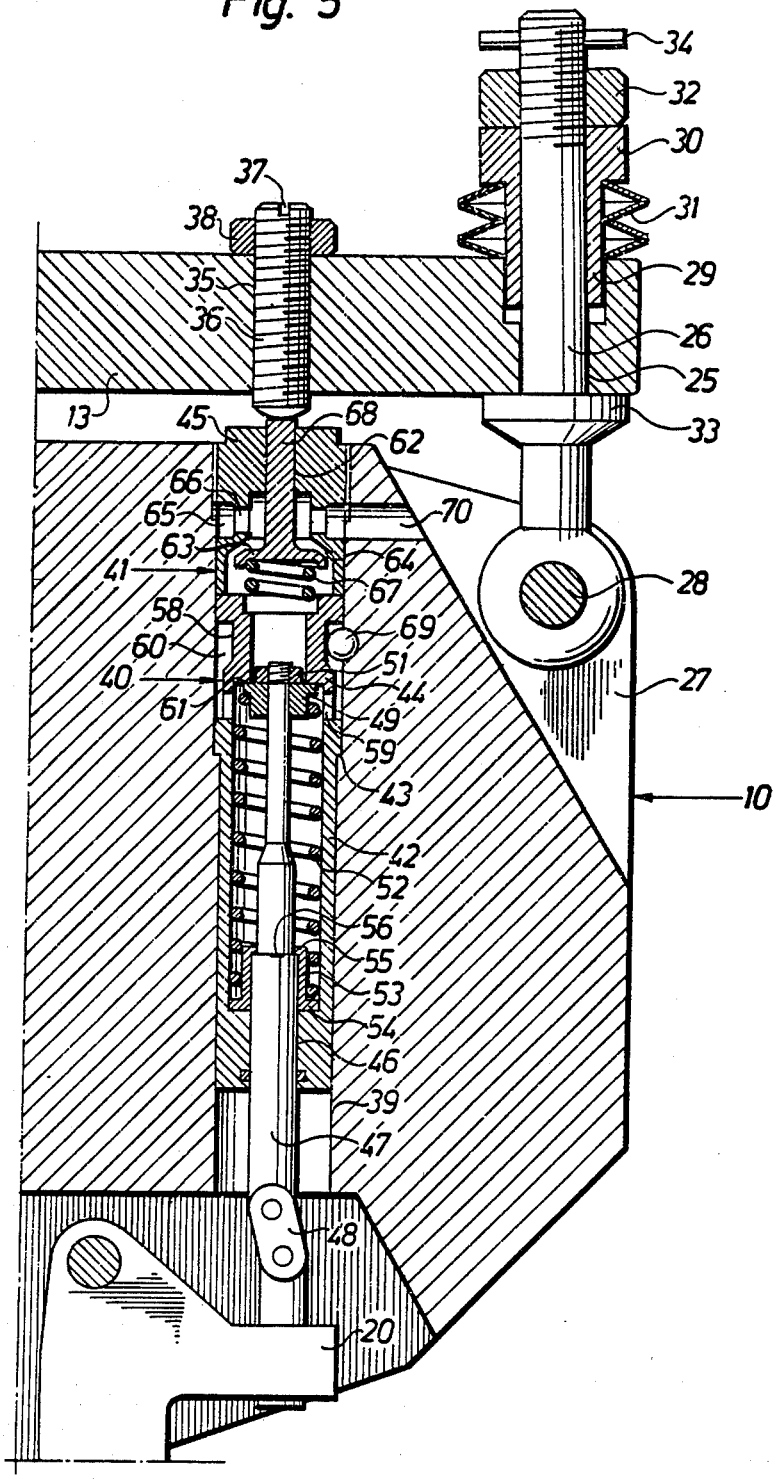
FIG. 5 is a corresponding detail view shown on a larger scale and illustrating the construction of the shunt and blocking valves.

As shown in FIGS. 2 to 4, the yoke 13 has at one end an inwardly horizontally extending lip 23 which engages in a groove 24 in the housing 10. The lip 23 fits loosely in the groove 24, thereby permitting a degree of pivoting of the yoke 13 relative to the housing 10 about said lip 23. At its other end, the yoke 13 has a vertical bore 25 through which a connecting rod 26 extends. The latter is mounted with its lower end in a slot 27 in the housing 10 and is secured to the latter by a bolt 28.

At its upper end the connecting rod 26 is provided with a sleeve 29 having a radial flange 30. Between the flange 30 and the upper surface of the yoke 13, there is inserted a pile of Belleville springs 31. These washer springs 31 form together a yieldable load transferring means between the hoist housing 10 and the yoke 13.

The Belleville springs 31 are subjected to a given preload by tightening of a nut 32 screw threadedly engaging the upper end of rod 26, against the upper end of the sleeve 29. Under a no-load condition of the hoist the entire preload set by the nut 32 is transferred back to the rod 26 via a rigid annular flange 33 on the latter. A transverse pin 34 is inserted through the upper end of the bolt 28 to prevent the nut 28 from falling off the latter.

Inwardly of the vertical bore 25 mounting the connecting rod 26, the yoke 13 is provided with a vertically extending screw threaded bore 35 through which a set screw 36 extends. This set screw 36 is formed at its upper end with a transverse slot 37 engageable by a screw driver and carries a lock nut 38 by means of which the screw 36 can be secured in any desired position.

Substantially coaxially with the set screw 36, the housing 10 is provided with a vertical bore 39 in which a control valve mechanism is located. This valve mechanism comprises a blocking valve 40 operatively connected with the rocking frame 20 and a shunt valve 41 (see FIG. 5 in particular). In this vertical bore 39, there is mounted a support sleeve 42 supported via a flange at its upper end on a shoulder 43 in said vertical bore 39, an intermediate sleeve 44 and an upper sleeve 45 screw threadedly engaged in a threaded upper part of the bore 39 so as to axially secure the support and intermediate sleeves 42, 44 against the shoulder 43.

At the bottom end of the support sleeve 42, there is provided a guide bore 46 through which a blocking valve stem 47 extends. The latter is coupled to the rocking frame 20 via a linkage 48 and carries at its upper end a blocking valve element 40 which is slidable along the stem 47 but is prevented from falling off the stem 47 by a stop nut 51. A coil type compression spring 52 is disposed to act between the valve element 49 and an outer flange 54 at the base of a reaction sleeve 53 which reaction sleeve 53 has at its upper end an inner flange 55 disposed in abutment with a shoulder 56 on the stem 47.

The arrangement of the compression spring 52 between the axially displaceable valve element 49 and the reaction sleeve 53 means that the spring 52 is compressed further in the load raising and load lowering positions than in the neutral position of the hoist (see below). This results in an automatic biasing of the selector valve 18 and the rocking frame 20 towards their neutral positions.

The intermediate sleeve 44 rests upon the upper end of the support sleeve 42 and is provided with an external waist 58 which together with the internal wall surface of the housing vertical bore 39 defines an annular chamber 60. A number of radial openings 59 is provided at the lower end of the intermediate sleeve 44 to establish communication between the annular chamber 60 and the interior of the intermediate sleeve 44. The latter also has an annular blocking valve seat 61 located above the openings 59 and intended for co-operation with the blocking valve element 49 of the blocking valve 40, the operation and purpose of which is further described below.

The upper sleeve 45 is provided with an axial bore 62 for guidedly supporting an upper valve element 63 and a valve seat 64 for sealing co-operation with said upper valve element 63, said seat and element 64, 63 constituting the shunt valve 41. The upper sleeve 45 also has an external peripheral groove 65 located above the valve seat 64 and a number of radial openings 66 connecting the groove 65 with the interior of said upper sleeve 45. A shunt valve coil type compression spring 67 is disposed between the upper end of the intermediate sleeve 44 and the shunt valve element 63 so as to bias the latter towards its closed position.

The valve element 63 of the shunt valve 41 also has a stem portion 68 which projects out of the bore 62 through the upper sleeve 45 and axially abuts the lower end of the set screw 36.

An air passage 69 extends through the housing from the housing vertical bore 39 at the level of the waist 58 of the intermediate sleeve 44 i.e. from the annular chamber 60 to one of the ports of the vane motor 15. A further passage 70 extending through the housing connects the peripheral groove 65 of the upper sleeve 45 with the atmosphere.

The vane type drive motor 15 illustrated in FIGS. 2 to 4, comprises a cylindrical chamber in a motor housing 72 with an eccentrically mounted rotor 73 having a plurality of radially sliding vanes 74 on the rotor 73, the housing 72 having first and second flow passages including first and second air communication ports 75 and 76 respectively. In use of the motor 15, the first and second flow passages alternately function as a pressurized air inlet and an air exhaust passage, respectively, depending on the direction of rotation of the rotor 73.

In the first port 75, there is mounted a leaf spring valve 77 provided with a restricted diameter opening 78. The leaf spring valve 77 is clamped at one end to the motor housing 72 by means of a screw 79 so that a pre-load in the closing direction of said leaf spring valve 77 is obtained, whereby the leaf spring valve 77 functions as a back flow restricting valve.

In FIG. 6, there is shown in diagrammatic form the control system with which the operation of the hoist is governed. The various different valves described above are identified with the same reference numerals in the diagrammatic FIG. 6 as in the other more representational figures.

The mode of operation of the hoist of the invention will now be described with reference both to FIGS. 1 to 5 showing the physical construction and to the diagram of FIG. 6.

The hoist is suspended by its hook 12 from a suitable overhead structure such as a trolley on rails (not shown), and the air inlet nipple 19 is connected to a pressurized air source. The hoist is now ready for use.

Depending on the weight of the workload attached to the load engaging hook 17, the Belleville springs 31 are compressed to a greater or lesser extent, the actual setting of the set screw 36, determining the load level at which the shunt valve element 63 is shifted from its open to its closed position. When the load on the hook 17 is small or non-existent, the Belleville springs 31 are very little compressed which means that the distance between the yoke 13 and the housing 10 is kept small. This means in turn that the set screw 36 holds the shunt valve element 63 depressed against the action of the stunt valve compression spring 67, and communication between the inside of sleeve 45 and the atmosphere is maintained. This condition obtains in all the figures of the drawings.

In the position of the control means shown in FIG. 2, the hoist is in its rest position. Accordingly, the handle 22, the rocking frame 20 and the selector valve 18 are all in their neutral positions. The blocking valve 40 is also closed and the back flow restricting valve 77 occupies its flow restricting position.

In the situation shown in FIG. 3, the handle 22, the rocking frame 20 and the selector valve 18 are shifted to their load lowering positions. Thus the selector valve 18 supplies pressurized air to the second port 76 of the vane motor 15 and allows exhaust air from the first port 75 to reach the atmosphere. Because of the fact that in this case the load on the load engaging hook 17 does not exceed the predetermined value at which the Belleville springs 31 are compressed far enough to cause the shunt valve 41 to close, the second air exhaust passage (69, 65, 66, 70) remains fully open and the interior of the upper sleeve 45 is vented to the atmosphere via the radial openings 66, peripheral groove 65 and second passage 70. As the rocking frame 20 is shifted to its load lowering position the blocking valve stem 47 is pulled downwardly and the blocking valve element 49 displaced from the blocking valve seat 61, thereby providing a through communication from the vane motor first port 75 to the atmosphere via the shunt valve 41. By this means a "second air exhaust passage" extending from the motor 15 to the atmosphere and comprising the air passage 69, annular chamber 60, intermediate sleeve radial openings 59, blocking valve 40 and shunt valve 41 openings, upper sleeve radial openings 66 and peripheral groove 65, and the further passage 70 through the housing 10, is established. Thus although in the case of lowering of a light load the normal motor exhaust via the first port 75 is restricted by the valve 77, the presence of the open "second air exhaust passage" permits an increased motor speed and hence a faster lowering of the load. The same situation is also illustrated in the circuit diagram of FIG. 6.

If, however, a heavier load is attached to the load engaging hook 17 the Belleville springs 31 will be further compressed and the distance between the yoke 13 and the housing 10 increased so that the set screw 36 will no longer be able to hold the "load sensitive" shunt valve 41 in its fully open position. This will immediately result in restriction or interruption of communication through the "second air exhaust passage" so that most or all of the exhaust flow from the motor has to pass through the restricted diameter opening 78 of the leaf spring valve 77 with the result that the motor speed and hence the load lowering speed are effectively brought down to a slow and safe level.

When shifting the rocking frame 20 and the selector valve 18 to their load raising positions as shown in FIG. 4, the valve element 49 of the blocking valve 40 is maintained in sealing contact with the blocking valve seat 61 by the action of the associated compression spring 52. Communication through the "second air exhaust passage" is always blocked, no matter how small a load is attached to the hook 17. This is however absolutely necessary, because in this situation pressurized air is supplied to the first port 75 to drive the vane motor 15 in its load raising direction and because of this not even a very small pressure leakage through the "second air exhaust passage" would be acceptable. Accordingly, the position of the load sensitive shunt valve 41 has no influence at all upon the air flow through the motor 15 during raising of a load.

In the load raising situation, the leaf spring valve 77 is displaced by the pressurized air supply to fully uncover the first port 75, so that the incoming pressurized air is able to reach the drive chamber of the motor 15 without passing through the restricted diameter opening 78. This means that the motor 15 is able to deliver maximum power during raising of loads.

By changing the setting of screw 36, it is readily possible to alter the weight limit for light loads which can be lowered at increased speed in a quick and simple manner.

I claim:

1. In a pneumatically operated hoist comprising a housing (10) provided with a suspension means (12, 13) for suspension of the hoist, a pneumatically driven motor (15) provided with a first flow passage (75) arranged for serving as a pressurized air inlet during raising of a load and as an air exhaust passage during lowering of the load and a second flow passage (76) arranged for serving as an air exhaust passage during raising of the load and a pressurized air inlet during lowering of the load, a load engaging means (16, 17) drivingly connected to the motor (15), and control means (18) coupled to said motor for regulating air flow to and from the motor (15);

the improvement wherein:

said control means includes a flow restricting means (77, 78) provided in said first flow passage (75) and arranged for restricting flow through said first flow passage (75) during lowering of the load; and a load sensitive shunt valve (4) arranged for providing a second air exhaust passage (69, 70) during lowering of a load having a weight below a predetermined magnitude and for closing said second air exhaust passage (69, 70) during lowering of a load having a weight greater than said predetermined magnitude.

2. A hoist according to claim 1, wherein said control means further includes a selector valve (18) switchable between a neutral position, a load raising position and a load lowering position; and a blocking valve (40) connected in series with said shunt valve (41) for controlling the second air exhaust passage (69,70) and operatively interconnected with said selector valve (18) so as to be shifted from an open position to a closed position as said selector valve (18) is switched from its load lowering to its load raising position.

3. A hoist according to claim 2, wherein said suspension means has an abutment means (36) thereon; and said shunt valve (41) and said blocking valve (40) extend generally vertically in the housing (10) and coaxially of each other; and said shunt valve (41) includes an upwardly extending valve displacement means (68) disposed for co-operation with said abutment means (36) on said suspension means.

4. A hoist according to claim 3, wherein said abutment means (36) comprises an adjustable set screw on said suspension means and arranged for adjustment of the predetermined load weight at which the abutment means displaces the shunt valve (41) to its closed position.

5. A hoist according to any one of claims 1 to 4, wherein said flow restricting means (77,78) comprises a movable valve element (77) displaceable between its flow restricting position for load lowering and a non-flow restricting position for load raising.

6. A hoist according to claim 5, wherein said movable valve element (77) of said flow restricting means comprises a leaf spring which is preloaded towards its flow restricting position and which is arranged to be resiliently displaceable to its non-flow restricting position by the pressure of the pressurized air supply through the first flow passage (75) during raising of the load.

7. A hoist according to claim 1 or claim 2 wherein said suspension means (12, 13, 26, 31) includes a resiliently deformable biasing means (31) which is arranged to deform under the weight of a load supported on said load engaging means (16, 17); and wherein said shunt valve (41) is arranged to be displaced by said suspension means (36, 13) towards its closed position for closing of said second air exhaust passage (69, 70) in response to increased deformation of said biasing means (31).

8. A hoist according to claim 7, wherein said suspension means (12, 13, 26, 31) comprises a yoke (13), said yoke (13) being pivotally connected to said housing (10) at one end and being connected at its other end to said housing (10) through said biasing means (31).

9. A hoist according to claim 8, wherein said biasing means (31) comprises a pile of Belleville springs.

10. A hoist according to claim 7, wherein said biasing means (31) comprises a pile of Belleville springs.

11. A hoist according to any one of claims 1–4, wherein said suspension means comprises a yoke (13) for suspension of said hoist from an overhead support.

* * * * *